United States Patent [19]

Cronmiller

[11] 4,339,000

[45] Jul. 13, 1982

[54] METHOD AND APPARATUS FOR A BRIDGE PLUG ANCHOR ASSEMBLY FOR A SUBSURFACE WELL

[76] Inventor: Clifford P. Cronmiller, 8398 Leeward Dr., Huntington Beach, Calif. 92646

[21] Appl. No.: 182,289

[22] Filed: Aug. 28, 1980

[51] Int. Cl.[3] ..... E21B 33/134; E21B 43/112

[52] U.S. Cl. ..... 166/295; 166/55.2; 166/63; 166/120; 166/297; 166/299; 166/387

[58] Field of Search ..... 166/285, 286, 295, 297, 166/298, 299, 55.1, 55.3, 55.2, 63, 118, 120, 212, 206, 192, 387, 386

[56] References Cited

U.S. PATENT DOCUMENTS

| | | | |
|---|---|---|---|
| 2,468,729 | 5/1949 | Black | 166/55.2 X |
| 2,591,807 | 4/1952 | Greene | 166/286 |
| 2,718,264 | 9/1955 | Allen et al. | 166/286 |
| 2,813,584 | 11/1957 | Teplitz | 166/299 X |
| 3,062,294 | 11/1962 | Huitt et al. | 166/55.2 X |
| 3,176,770 | 4/1965 | Ehlert | 166/63 X |
| 3,208,521 | 9/1965 | Holland et al. | 166/285 X |
| 3,208,525 | 9/1965 | Caldwell et al. | 166/286 X |
| 3,578,083 | 5/1971 | Anderson et al. | 166/285 |
| 3,724,550 | 4/1973 | Lammon | 166/285 |

*Primary Examiner*—Stephen J. Novosad
*Attorney, Agent, or Firm*—Fischer, Tachner & Strauss

[57] ABSTRACT

A method of fabrication and the resulting structure for an economical and reliable anchor assembly to retain a conventional bridge plug within the production casing of an oil or gas well. The anchor assembly is efficiently loaded into the well and interfaced with the bridge plug via a packer and tubing, thereby eliminating the necessity of employing an expensive workover rig, which is common to many conventional well plugging techniques. The preferred method includes the step of deforming (i.e. perforating) the production casing for interlocking the anchor assembly therein. By virtue of the instant anchor assembly, a reliable plug may be installed to effectively plug back a depleted zone of an oil or gas well, while withstanding the generally large differential pressures that may be encountered at relatively deep subsurface production zones during a subsequent stimulation of the well.

14 Claims, 8 Drawing Figures

METHOD AND APPARATUS FOR A BRIDGE PLUG ANCHOR ASSEMBLY FOR A SUBSURFACE WELL

BACKGROUND OF THE INVENTION

1. Field of the Invention

This invention relates to a method and apparatus for economically and reliably anchoring a conventional bridge plug within the production casing of a completed oil or gas well.

2. Prior Art

A conventional means and a well-known method for plugging a completed oil or gas well is best described when referring to FIG. 1 of the drawings. As will be recognized by those skilled in the art, the subsurface formation 2 of a site upon which a well is to be completed often has formation characteristics (such as fluid saturation and the distribution of permeability and porosity) that are indicative of commercial accumulations of trapped hydrocarbons at multiple pay zones. A hole 1 of suitable dimension is drilled into the subsurface formation 2 at the well-site, and a pipe 4 is extended therethrough. By way of example, the pipe 4 is a production casing having a five inch outside diameter. Casing 4 is usually fabricated from a suitable high strength material such as steel, or the like. The casing 4 generally comprises pipe sections of approximately 30 feet in length that are connected end-to-end with one another. An area 6 lying between the subsurface formation 2 of the well-site and the casing 4 is typically constructed and filled with a cement, in order to provide the well with sufficient zonal isolation. The cement selected to fill area 6 has suitable temperature and pressure resistant characteristics. By way of example, one type of cement that is available for utilization in the completion of an oil or gas well is that commonly known as American Petroleum Institute (API) Class E cement.

A hollow, cylindrical production packer 8 is run down the hole 1 and secured to the sides of casing 4 at a suitable location above the lower-most production zone, wherein high concentrations of hydrocarbons have been detected. By way of example, the lower-most production zone may occur at a depth of approximately 10,000–15,000 feet. The packer 8 is generally fabricated from a two foot long section of high strength material, such as iron, or the like. As will be known to those skilled in the art, the packer 8 has associated therewith a plurality of slips 10, or biting edges. When packer 8 is lowered to a desired position in hole 1 above a production zone, an explosive charge is detonated, whereby to cause the slips 10 to penetrate and bite the walls of casing 4 and, thereby, secure the position of packer 8 thereat. A run of tubing 12 is inserted into the hole 1, so that the downside end thereof is received by packer 8. Hence, the packer 8 acts to retain tubing 12 above the anticipated production zone, so as to prevent a blow-out of tubing 12 when receiving hydrocarbons that are released at high pressures.

The conventional oil or gas well is completed when a plurality of perforations 14 are formed to permit the interface of tubing 12 with the (lower-most) production zone, wherein trapped deposits of hydrocarbons lay. As will be understood by those skilled in the art, the perforations are created by either of well-known bullets or jet shots by conventional perforating guns at high pressure. The perforations 14 extend through the walls of casing 4 and the cemented area 6, so as to communicate with the production zone.

As will be recognized by those skilled in the art, after the completion of the oil or gas well, the subsurface formation 2 may be fractured (in the event of a low permeability formation) according to conventional techniques, by applying to the production zone thereof a fracturing solution (i.e. gel) under high pressure. The fracturing solution is conveyed to the production zone via tube 12 and each of the plurality of perforations 14. Upon termination of the fracture treatment, suitable access to the trapped hydrocarbons can be achieved, so that accumulated oil or gas deposits may be extracted from the hole 1 through perforations 14 and tubing 12.

Upon depletion of the deposited hydrocarbons in the (lower-most) production zone, it is usually desirable to tap deposits that are trapped in other production zones located at lesser depths below the surface of the wellhead. However, and prior to the time when a new production zone may be treated, the depleted, lower-most production zone and the new, untapped production zone must be isolated from one another. As will be appreciated by those skilled in the art, one conventional technique by which to plug back the perforations 14 associated with the lower-most production zone and thereby block communication with well hole 1 contemplates the utilization of a well-known workover rig (not shown). The workover rig is positioned over the hole 1 and is adapted to release the tubing 12 from the packer 8, so that tubing 12 can be withdrawn from the interior of hole 1. However, in order to remove packer 8 so as to squeeze cement into perforations 14, the packer 8 must be destroyed. The destruction of packer 8 is typically accomplished by means of drilling thereover with a suitable milling bit. A suitable plug 15 is then inserted into hole 1 by a conventional squeeze process, whereby to plug the perforations of the lower-most production zone. By way of example, the aforementioned plug 15 is deposited at the bottom of hole 1 by pumping cement, under pressure, thereto. After sufficient time for the cement plug to cure, a new packer and tubing are fixedly inserted within hole 1 above the new production zone. Access to the new production zone may thereupon be obtained to recomplete the well, as was previously disclosed.

However, the conventional procedure for withdrawing hydrocarbons from multiple production zones lying at various subsurface depths is highly disadvantageous. That is, very expensive operating costs are attributable to the utilization of a workover rig (to seal up a lower-most production zone and to recomplete the well), the intricate tooling commonly associated therewith, and the need for trained operators. Furthermore, work over of the well will accelerate wear and promote an early replacement of the related tooling. Accordingly, the high operating costs associated with a workover rig relative to the expected yield often contributes to the capping of those wells having only moderate production capabilities. The lack of production zones of sufficiently large area may make the completion of an oil or gas well commercially unfeasible, because of the expense of recompleting from one zone to another. Hence, vast reserves of greatly needed hydrocarbons may go substantially untapped.

Moreover, utilization of a workover rig and the conventional technique for recompleting an oil or gas well is relatively time consuming. That is, the time which has heretofore been expended to remove the packer and tubing so as to permit a cement plug 15 to be inserted and cured each time that a new production zone is to be completed and stimulated undesirably reduces the efficiency by which needed hydrocarbons can be obtained.

What is more, and as previously disclosed, each time that the hydrocarbon deposits are depleted from a lower-most production zone, the packer is first destroyed, so that a squeeze can be performed on the production zone being abandoned. The destructive process required to gain access to new production zones further increases both the risk of damage to production casing 4 and the cost associated with the development of oil and gas reserves.

What is still more, the cement plug 15 that is usually deposited at the bottom of the oil or gas well to plug back an old production zone is both expensive and, at times, unreliable. That is, increasing formation pressures commonly associated with production intervals at large subsurface depths are known to cause fissures within the conventional cement plug. Such fissures may undesirably result in communication between an old, depleted production zone and a new, untapped zone located thereabove.

Therefore, as will be readily appreciated by those skilled in the art, prior art apparatus and procedures by which to complete and recomplete an oil or gas well in order to successively tap a plurality of production zones is highly disadvantageous, because of the high costs, time consumption, and unreliability generally associated therewith.

SUMMARY OF THE INVENTION

Briefly, and in general terms, a method for fabricating and the resulting structure are disclosed for a reliable anchor assembly that is interfaced with a conventional bridge plug to withstand relatively large down-hole pressures that are encountered in deep oil or gas wells. According to one preferred embodiment of the present invention, a conventional bridge plug is suitably positioned within the production casing of the well in order to plug back a production zone, wherefrom trapped hydrocarbons have been depleted. A first method for anchoring the bridge plug and enhancing the integrity of the seal made thereby includes the steps of depositing of supply of cement to form a first plug member atop the bridge plug and permitting the cement thereof to cure. A plurality of perforations are formed through the production casing above the first plug member. Another supply of cement is deposited over the first plug member to form a second plug member in that portion of the production casing through which the perforations are formed. A resinous (e.g. epoxy) material is deposited over the second plug member and permitted to solidify. Prior to the curing of the cement of the second plug member, pressure is applied over the solidified epoxy, so as to drive the epoxy toward the first plug member. Accordingly, the second plug member is compressed between the epoxy and the first plug member, so that the cement of the second plug member is squeezed into and through the perforations formed in the casing. The cement of the second plug member is cured under pressure, whereby the cement in the perforations provides the present anchor assembly with a suitable footing to maximize the reliability thereof for retaining the bridge plug within the production casing.

According to another preferred embodiment of the invention, a second method for reliably anchoring a conventional bridge plug within a production casing includes the steps of depositing a supply of cement to form a plug member atop the bridge plug and permitting the cement thereof to cure. A flexible and elongated, rippled strip comprising a series of undulations is positioned over the cement plug. A sharp barb having biting edges is attached at the peak of each wave. Each of the barbs includes an explosive charge, so that upon the respective detonations, the barbs are driven through the production casing, whereby the biting edges thereof are retained in an interlocking engagement with the casing walls. Another supply of cement is deposited over the rippled strip and the associated barbs. The aforementioned cement is cured under pressure to enhance the sealing integrity of the anchor assembly of the present embodiment and to better adapt the bridge plug to withstand relatively large differential pressures.

DESCRIPTION OF THE PREFERRED EMBODIMENT

Figure 2:
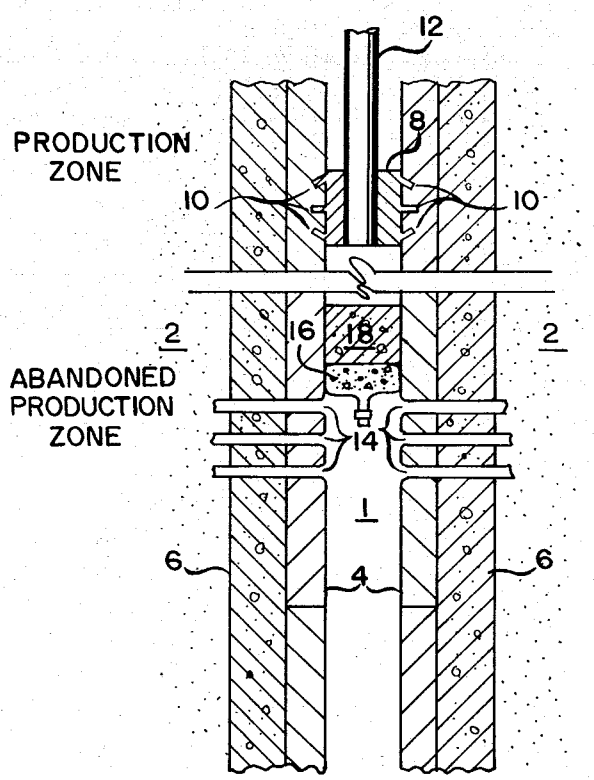
FIG. 2 (PRIOR ART)
FIGS. 1 and 2 is illustrative of partial cross-sections of oil or gas wells that have been plugged according to two respective prior art techniques.
Figure 1:
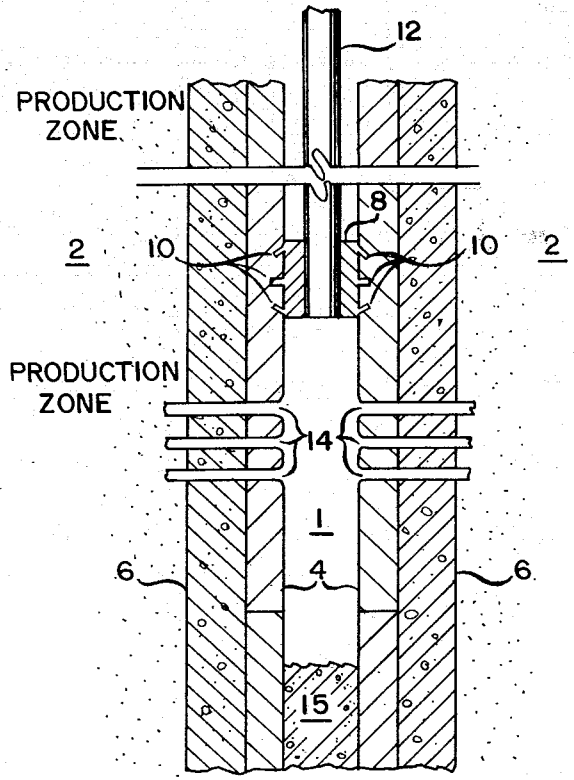
FIG. 1 (PRIOR ART)

FIG. 2 of the drawings represents a prior art attempt to overcome the above-identified problems commonly associated with recompleting an oil or gas well. The embodiment illustrated in FIG. 2 obviates the need for the expensive workover rig, whch has heretofore been required for wells in which suitable production zone abandonment requires a plug of high differential pressure integrity. More particularly, and similar to that described when referring to FIG. 1, a hole 1 of suitable dimension is drilled into the subsurface formation 2 of a well-site in which commercial accumulations of hydrocarbons have been detected. A casing 4 is run down the hole 1 and cemented in place at an area 6 that provides zonal isolation between subsurface formation 2 and the casing 4. A cylindrical packer 8 is secured to the sides of casing 4 by means of slips 10, and a run of tubing 12 is anchored in hole 1 by packer 8. However, and unlike the completed well shown in FIG. 1, the packer 8 of FIG. 2 is attached to the walls of casing 4, so that the downside end of tubing 12 is disposed above the uppermost production zone having the least subsurface depth (i.e. that closest to the well-head).

When a lower-most production zone has been depleted and it is desirable to recomplete an uphole production zone, communication between the perforations 14 associated with the lower-most production zone and the well hole 1 is blocked by means of a plug 16, whereby to create an artificial bottom within the oil or gas well. More particularly, the plug 16 which forms the artificial bottom in hole 1 is commonly referred to as a bridge plug. Bridge plug 16 is lowered through tube 12 to be positioned between the walls of casing 4. Hence, the prior art through-tubing bridge plug 16 eliminates the previous destruction of original packer 8 and the removal of tube 12 from the well hole 1. As will be known to those skilled in the art, a bridge plug comprises a suitable material, such as a cement, or the like, that is surrounded by a resilient (e.g. rubber) material. It is desirable that the material (i.e. cement) selected to form the conventional bridge plug be capable of expanding during the curing thereof. The expansion of the (cement) material is intended to ensure the retention of the bridge plug 16 across casing 4 at a location above a depleted production zone. When the bridge plug 16 is suitably cured, (typically) ten feet of cement 18 is deposited over the top thereof via tubing 12. The purpose of cement 18 is to pack plug 16 and improve the seal made with the walls of casing 4. By way of example, one such bridge plug which is similar to that disclosed while referring to FIG. 2 is that commercially known as a Plus Plug, manufactured by Schlumberger Ltd.

However, many inherent difficulties are known to exist when utilizing the conventional bridge plug 16, such as that described immediately above. More particularly, the bridge plug 16 has not been totally effective for properly sealing all depleted production zones, inasmuch as the high pressures commonly associated with fracture treatments can cause the bridge plug 16 to be forceably thrust down the hole 1 (i.e. similar to the effect of a piston drive). By way of example, a conventional cement bridge plug 16 is typically rated to withstand a differential pressure of 5000 psi. However, such a rated plug 16 has been found to be insufficient for use in deep oil or gas wells, when production zones are to be fracture treated at depths where differential pressures commonly exceed 15,000 psi at sandout. Because of the lack of any readily available and reliable anchoring device therefor, the conventional bridge plug may become dislodged from casing 4, whereby to undesirably expose the perforations 14 associated with a lower (i.e. deeper) production zone. Accordingly, the utilization of a conventional bridge plug 16 may be both inefficient and unreliable from recompleting an oil or gas well in order to successively fracture a series of production zones occurring at relatively great depths below the well head.

Figure 3:
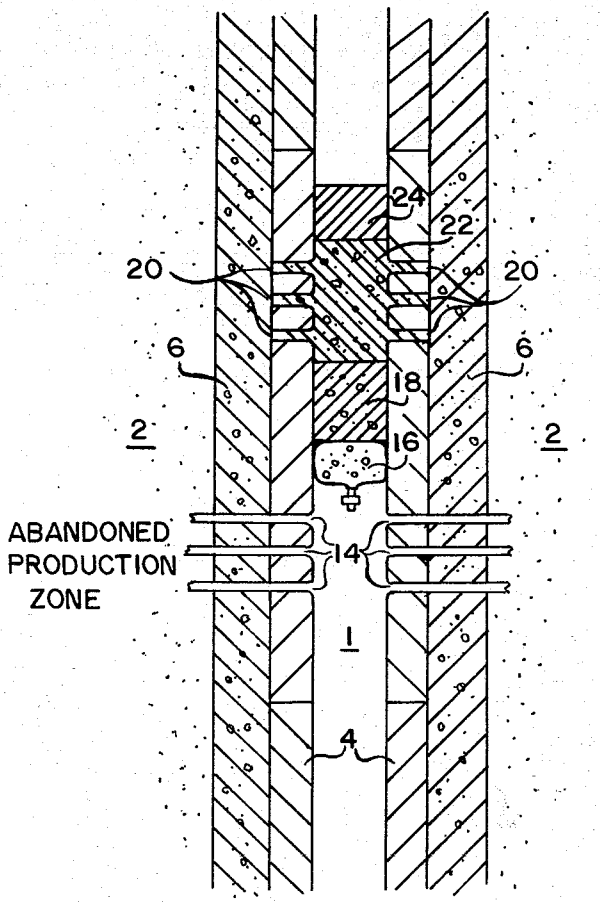
FIG. 3 shows a partial cross-section of an oil or gas well that has been plugged by means of a unique anchor assembly and according to a method of installation that form a first preferred embodiment of the present invention.

Referring to FIG. 3 of the drawings, one preferred embodiment of the present invention is shown for fabricating an efficient and an easily installed anchor assembly to reliably retain a conventional bridge plug within an oil or gas well. The anchor assembly disclosed hereinbelow provides greater sealing integrity to better withstand the relatively large differential pressures that are typically encountered by a conventional bridge plug at large depths below the well head. In accordance with the first preferred embodiment, the initial step of a method for reliably plugging the well hole 1, whereby to plug back and isolate a lower-most, depleted production zone from a new, untapped production zone, includes the step of filling the well hole 1 with salt water. The purpose of the salt water is to function as a hydraulic fluid, so as to facilitate the loading of well hole 1 with a bridge plug and the instant anchor assembly therefor. The salt water also fills perforations 14 to prevent gases being leaked from the lower-most production zone from undesirably forcing the plug up the hole. It is to be understood that any other suitable fluid, such as fresh water or weighted mud, may be substituted for the aforementioned salt water.

Next, a conventional bridge plug 16, such as that described in the paragraphs above, is installed by running plug 16 down the well hole 1 through the packer and its associated tubing (best shown in FIG. 2). After waiting a sufficient time for the cement of the bridge plug 16 to cure and expand against the walls of casing 4, a bottom cement plug member 18, typically ten feet in length, is deposited over the top of bridge plug 16 in similar fashion to that described when referring to FIG. 2. It is desirable that the subsurface formation 2, behind that portion of the casing 4 and cemented area 6 adjacent which the bridge plug 16 is located, contains relatively large accumulations of shale, rather than sandstone, or the like. A suitable time (e.g. 24–36 hours) is permitted to elapse for the curing of the bottom cement plug 18.

A footing for the instant bridge plug anchor assembly is formed by running a conventional perforating gun down the well hole 1 and creating a plurality of perforations 20 immediately above cement plug 18. It is desirable that perforations 20 have relatively large diameters, but relatively short penetrations beyond the casing 4. By way of example, two-to-four shots per foot are delivered by the perforating gun through the casing 4, depending upon the material strength thereof. The plurality of perforations 20 extend over an interval of between 10 to 20 feet in length above lower cement plug 18. After perforations 20 are completed, an intermediate plug member 22 is formed by applying a supply of slow setting cement having a high coefficient of expansion down the well hole 1 and over the top of the plug 18 (via the packer tubing). By way of example, API Class E cement may be deposited over bottom plug 18, according to conventional dump-bailing techniques, to form intermediate plug 22. Intermediate plug 22 extends for an inhole length that is common to the interval containing perforations 20 (i.e. 10 to 20 feet). As will be disclosed shortly, the enlarged perforations 20 provide a suitable footing for receiving cement therein from intermediate plug 22, whereby to retain plug 22 in a desired position between the walls of casing 4.

Prior to the time that the slow setting cement of the intermediate plug 22 has cured, a supply of resinous material, such as epoxy, or the like material, is deposited thereover (through the packer tubing) to form a top plug or cylindrical slug 24. Typically, the epoxy slug 24 has an in hole length of approximately five feet above plug 22. As will also be disclosed shortly, epoxy slug 24 functions as a plunger for applying sufficient downward pressure on intermediate plug 22, whereby to compress plug 22 for forming a reliable seal between the walls of casing 4. The epoxy may be deposited in fluid form and according to conventional dump-bailing techniques.

Prior to the time that intermediate plug 22 has completely cured, but after epoxy slug 24 has sufficiently hardened, one or more well-known pump trucks (not shown) are positioned over the top of the well-head. The pump trucks can be utilized, as will be known by those skilled in the art, for the purposes of applying pressure to the top of the anchor assembly of the present invention and for compressing the slow setting cement of intermediate plug member 22 against bottom plug member 18. Pressure is increased on the instant anchor assembly, until the intermediate cement plug 22 is compressed slightly below the upper-most perforation 20. While under compression, cement from the intermediate plug member 22 is squeezed into the perforations 20, whereby to provide suitable footings or anchoring ports for retaining intermediate plug 22 and providing resistance to the adverse effects of down-hole pressures. When the (solidified) epoxy slug 24 communicates with the upper-most perforation 20, an increase in pressure can be detected by well-known pressure sensing means. When such a pressure increase is indicated, the corresponding pressure head over the anchor assembly is maintained by the pump trucks for a suitable time (e.g. 8–12 hours) until the cement of the intermediate plug member 22 has cured. When sufficient curing time has elapsed, compression of the present anchor assembly is terminated, and the pump trucks are removed from the well-head.

Accordingly, upon removal of the pressure head from the present anchor assembly, the walls of casing 4 tend to contract. This contraction of the casing walls combined with the expansion of the cement during the curing of intermediate plug member 22 results in a plug that can reliably plug back a depleted production zone. Moreover, by virtue of the method hereinabove disclosed, a unique in hole anchoring assembly is available for maintaining sufficient pressure on a bridge plug 16, so as to prevent said plug from becoming undesirably susceptible to those forces which could drive the plug up or down the well hole 1 as a consequence of either relatively large down-hole pressures or subsequent hydraulic fracture treatment. What is more, the anchor assembly may be economically installed to recomplete a well without requiring the removal from the well of either of the packer or its associated tubing.

A second preferred embodiment of the present invention for fabricating an efficient and easily installed anchor assembly to reliably retain a conventional bridge plug within an oil or gas well is illustrated in FIGS. 4–8 of the drawings. In accordance with the second embodiment and referring concurrently to FIGS. 4 and 5, the anchor assembly includes an elongated strip of spring steel 30, steel laminate, or the like, arranged in the shape of a rippled sheet or wave. The peak-to-peak amplitude of the waves of rippled strip 30 is selected to be slightly less than the inside diameter of the production casing in which strip 30 is to be inserted. Rippled strip 30 has a linear length of typically 20–30 feet, when in a relaxed condition. Attached to each peak of strip 30 is an identical barb or burr 32. By way of example, strip 30 may be formed with four peaks and, therefore, four barbs 32 respectively attached thereto. The details of a barb 32 are best described when referring to FIGS. 6 and 7, hereinafter.

Figure 5:
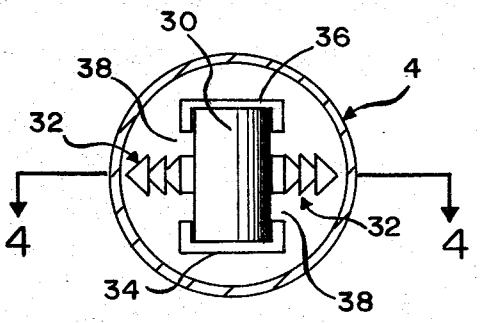
FIGS. 4–7 shows details of a unique anchor assembly that form a second preferred embodiment of the present invention.

The rippled strip 30 is initially restrained in a compressed condition by means of a pair of correspondingly sized, elongated (e.g. steel) C-shaped members 34 and 36. C-shaped members 34 and 36 are aligned so as to face one another, whereby to enclose strip 30 within a generally rectangular configuration. By way of specific example, when fitting the anchor assembly of the present embodiment into a well casing having a five inch outside diameter, a diagonal taken across the top of the rectangular configuration formed by C-shaped members 34 and 36 (as is best shown in FIG. 5) will be approximately $1\frac{3}{4}$ inches long. In the assembled relationship, the ends of C-shaped members 34 and 36 are separated from each other by strip 30, so as to form spacings 38 therebetween. The spacings 38 are suitably dimensioned in order to receive therethrough the plurality of barbs 32 that are attached to and project from the waves of rippled sheet 30. Hence, alternating ones of the barbs 32 extend through spacings 38 in opposite directions relative to one another.

Figure 4:
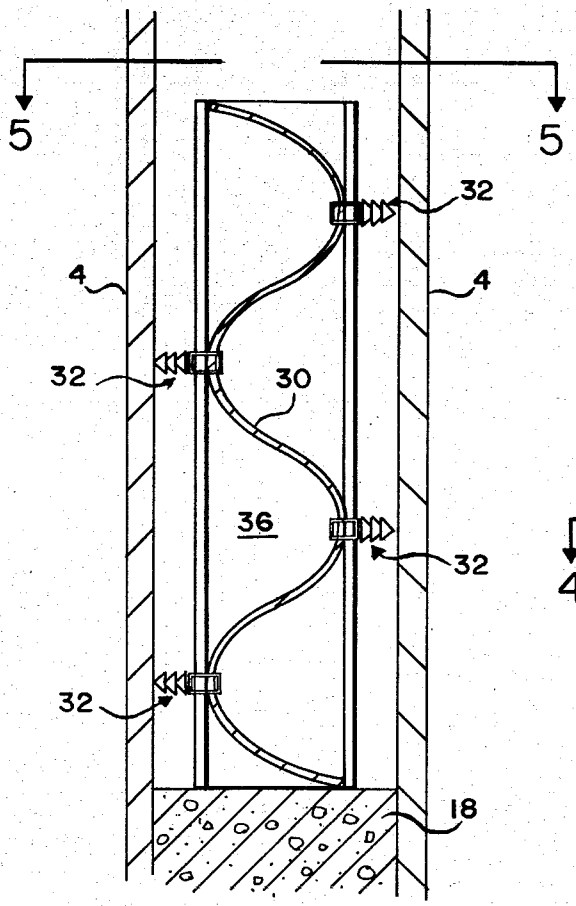

A method for installing the anchor assembly, which forms the second preferred embodiment of the invention, whereby to reliably plug a well hole and thereby isolate a depleted production zone is best described while continuing to refer concurrently to FIGS. 4 and 5. Similar to that disclosed when referring to FIG. 3, the well hole 1 is initially filled with a suitable hydraulic fluid, such as salt water, or the like.

A conventional cement bridge plug 16 is then installed by running the plug down the well hole 1 through the packer and its associated tubing (not shown). As is also similar to that previously disclosed, after the cement of bridge plug 16 has suitably cured and expanded against the walls of casing 4, a (ten foot) cement plug member 8 is deposited over the top of bridge plug 16. A suitable time is allowed to permit the curing of cement plug 18.

The combination including the pair of C-shaped members 34 and 36 and the rippled strip 30, which maintains strip 30 in a compressed condition, is lowered into the well hole 1 through the tubing, until said combination communicates with the top of cement plug 18. During the step of lowering rippled strip 30 into the well hole 1, the plurality of barbs 32 typically scrape the inside walls of casing 4. When the rectangular configuration comprising C-shaped members 34 and 36 and rippled strip 30 is suitably positioned atop the bridge plug 16 and cement plug 18, the C-shaped members 34 and 36 are separated from one another. By way of example, a small explosive charge (e.g. gunpowder) may be utilized to blast the C-shaped members 34 and 36 apart. The C-shaped members may remain within the hole 1 to serve as a reinforcing scrap material. Upon the separation of C-shaped members 34 and 36, the rippled strip 30 expands into a relaxed condition.

Figure 6:
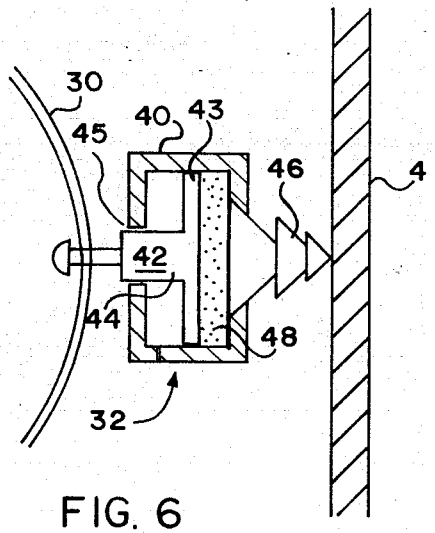

FIG. 6 of the drawings illustrates the details of one of the barbs 32 of strip 30 communicating with an inside wall of casing 4. More particularly, barb 32 includes a housing or cylinder 40. Positioned inside the walls of housing 40 is a plunger or piston member 42. One end of the plunger 42 is connected to rippled strip 30 by means of a rivet, or the like fastening means. The other end of plunger 42 comprises an elongated, flat face 43. The plunger 42 also includes a shank portion 44 connected between the aforementioned fastening means and the flat face 43. Shank 44 is of a suitable length so as to be received by and ride through an opening 45 formed in one end of housing 40. The flat face 43 of plunger 42 is, therefore, adapted for reciprocal movement through housing 40 as shank 44 rides through opening 45.

Attached to a second end of housing 40, which end is opposite that through which the shank 44 extends, is a knurled member 46. Knurled member 46 includes a plurality of biting or locking edges which extend therearound. Knurled member 46 is fabricated from a suitable material, such as, for example, case hardened steel, so as to be adapted to penetrate the walls of casing 4. An explosive charge 48 such as gunpowder, or the like, is stored within housing 40 between the second end thereof and the flat face 43 of plunger 42.

Figure 7:
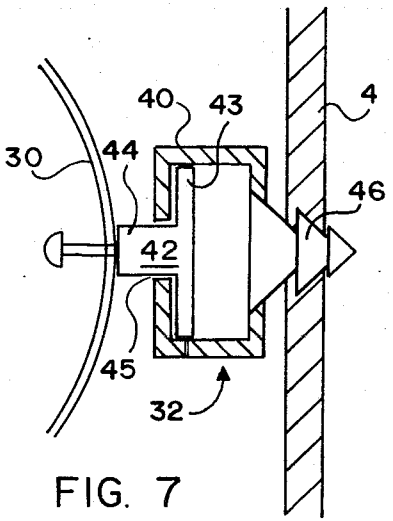

In operation, the explosive charge 48 may be detonated by means of a conventional wire line (not shown) which is run down the well hole and interconnected with each of the barbs 32. The expanding gases in housing 40 after the detonation of explosive charge 48 cause the plunger 42 to be directed away from knurled member 46. Therefore, as is best shown in FIG. 7 of the drawings, the biting edges of knurled member 46 are forced into the walls of production casing 4 in opposite reaction to the detonation of the explosive charge 48. As plunger 42 reciprocates through the opening 45 in housing 40, in reaction to the exploding charge, the flat face 43 thereof drives knurled member 46 through casing 4 and into interlocking engagement therein.

Figure 8:
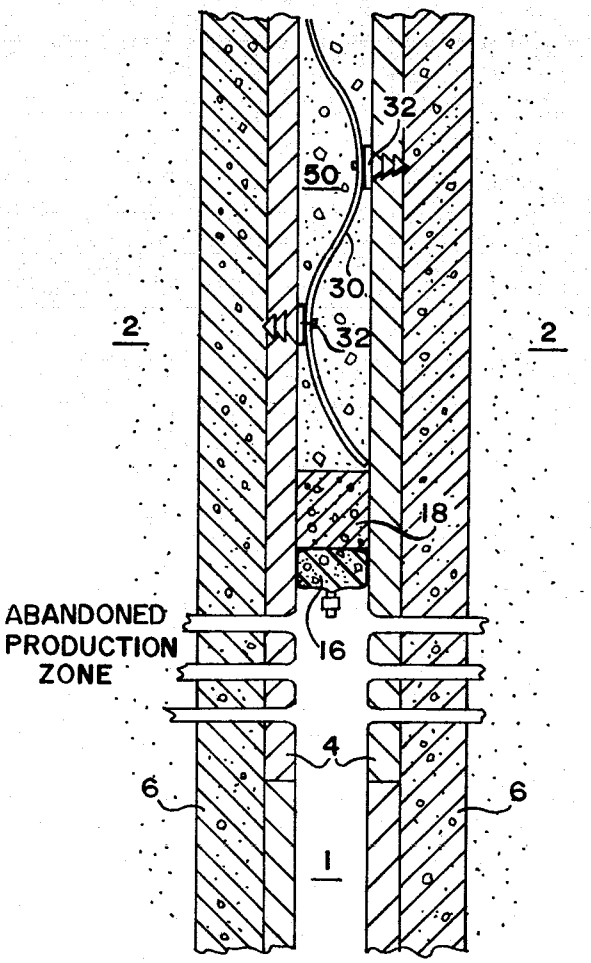
FIG. 8 shows a partial cross-section of an oil or gas well that has been plugged according to a method of installation which utilizes the anchor assembly of FIGS. 4–7.

Referring to FIG. 8 of the drawings, the anchor assembly of the present embodiment is shown with the knurled members 46 of barbs 32 protruding from the walls of casing 4, after the respective charges thereof have been detonated. The present anchor assembly is completed by depositing a supply of cement 50 (characterized by both a high strength and coefficient of expansion) according to conventional dump-bailing techniques, or the like, through the tubing and over each of the rippled strip 30 and the barbs 32. As in the method previously described while referring to FIG. 3, a pressure head may be maintained over the present anchor assembly by means of a pump truck, or the like, for a suitable time until the cement 50 has cured. Accordingly, by virtue of the method hereinabove disclosed, the corresponding in hole anchor assembly is adapted to maintain sufficient pressure on a bridge plug 16 and provide reinforced differential pressure integrity therefor, so as to prevent said plug from becoming undesirably susceptible to those forces which could drive the plug up or down the well hole 1, as a consequence of either relatively large down-hole pressures or a subsequent hydraulic fracture treatment of an uphole recompletion prospect.

It will be apparent that while a preferred embodiment of the invention has been shown and described, various modifications and changes may be made without departing from the true spirit and scope of the invention. By way of example, and as will be appreciated by those skilled in the art, the methods by which the anchor assemblies of the preferred embodiments of the invention are installed in an oil or gas well via the tubing may typically include the utilization of lubricators, casing collars, and additional conventional sealing and coupling tools. However, for the purposes of convenience and simplicity, a discussion of these well-known tools and their corresponding conventional applications herein have been omitted. Moreover, it is within the scope of the invention to drive barbs 32 through production casing 4 by any other suitable propulsion means employed with or as an alternative to the explosive charge.

Having thus set forth a preferred embodiment of the instant invention, what is claimed is:

1. A method for anchoring a bridge plug within a casing of a subsurface well, said method comprising the steps of:

forming a plurality of perforations through the wall of said casing at a location above the bridge plug, depositing a first supply of cement over the bridge plug for filling a portion of said casing corresponding to that through which the perforations are formed, positioning a mass over said first supply of cement and applying pressure to said mass for compressing the cement of said first supply against the bridge plug and for forcing some of said cement through the perforations in said casing, and curing said cement for providing a footing for anchoring the bridge plug within said casing.

2. The method for anchoring recited in claim 1, including the additional steps of forming said mass from a resinous material, conveying the resinous material in liquid form over said first supply of cement, and permitting said mass to solidify before applying pressure thereto.

3. The method for anchoring recited in claim 1, including the additional step of terminating the step of applying pressure to said mass when said first supply of cement is compressed so as to locate said mass adjacent a perforation formed through said casing wall.

4. The method for anchoring recited in claim 1, including the additional steps of forming said mass into a cylinder and fabricating said cylinder from epoxy.

5. The method for anchoring recited in claim 1, including the additional steps of depositing a second supply of cement over the bridge plug and curing the cement of said second supply, and depositing said first supply of cement over the bridge plug and said second supply of cement after said second supply has cured.

6. Apparatus to anchor a bridge plug within a casing of a subsurface well to reliably plug the well, said apparatus comprising:

a resilient strip positioned in said casing at a location above the bridge plug, and at least one barb attached to said strip, said barb having a housing in which an explosive charge is stored, said barb adapted to be driven through a wall of said casing and into locking engagement therewith when said charge is detonated.

7. The anchor apparatus recited in claim 6, additionally comprising a supply of cement deposited over each of the bridge plug, said resilient strip and said barb.

8. The anchor apparatus recited in claim 6, further comprising a plunger that is adapted to reciprocate within the housing of said barb, one end of said plunger being attached to said resilient strip, and the other end of said plunger having a surface for driving said barb into said casing wall when said explosive charge is detonated and said plunger reciprocates through said housing.

9. The anchor apparatus recited in claim 6, wherein said barb includes biting means connected at one end thereof, said biting means adapted to penetrate the wall of said casing when said explosive charge is detonated.

10. The anchor apparatus recited in claim 6, wherein said resilient strip comprises a series of undulations, said at least one barb attached to said strip at the peak of a respective undulation.

11. A method for anchoring a bridge plug within a casing of a subsurface well and for reliably plugging the well, said method comprising the steps of:

driving a plurality of interconnected barbs through the wall of said casing at a location above the bridge plug, and depositing a supply of cement over the bridge plug and said plurality of interconnected barbs.

12. The method recited in claim 11, including the additional steps of interconnecting said plurality of barbs by means of a resilient strip, and positioning said strip and the barbs connected thereto over the bridge plug before the step of driving said barbs through the casing wall.

13. The method recited in claim 12, including the additional steps of compressing said resilient strip during said last mentioned positioning step, and allowing said strip to expand after being positioned over the bridge plug and before the step of driving said barbs through the casing wall.

14. The method recited in claim 11, including the additional steps of loading each of said barbs with an explosive charge; and detonating said charges for driving said barbs through the wall of said casing.

* * * * *